US007471303B2

(12) United States Patent
Sawai

(10) Patent No.: US 7,471,303 B2
(45) Date of Patent: Dec. 30, 2008

(54) IMAGE FORMING DEVICE

(75) Inventor: Kunio Sawai, Daito, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 61 days.

(21) Appl. No.: 11/763,702

(22) Filed: Jun. 15, 2007

(65) Prior Publication Data

US 2007/0291098 A1 Dec. 20, 2007

(30) Foreign Application Priority Data

Jun. 20, 2006 (JP) ..... 2006-169505

(51) Int. Cl.
*B41J 2/335* (2006.01)

(52) U.S. Cl. ..... 347/197

(58) Field of Classification Search ..... 347/197, 347/198, 220; 400/120.16
See application file for complete search history.

(56) References Cited

U.S. PATENT DOCUMENTS 5,366,302 A * 11/1994 Masumura et al. ..... 400/120.16
7,399,130 B2 * 7/2008 Hirte et al. ..... 400/120.16

FOREIGN PATENT DOCUMENTS

| | | |
|---|---|---|
| JP | 11-254715 | 9/1999 |
| JP | 11-321013 | 11/1999 |
| JP | 2001-8 | 2/2001 |

* cited by examiner

*Primary Examiner*—K. Feggins
(74) *Attorney, Agent, or Firm*—Global IP Counselors, LLP

(57) ABSTRACT

An image forming device includes a thermal head, a head support portion, a platen roller, a pressing mechanism and a positioning portion. The thermal head prints in a printing direction. The head support portion rotatably supports the thermal head. The head support portion is supported at locations away from an imaginary line along the printing direction passing between the thermal head and the platen roller. The platen roller is disposed across from the thermal head. The pressing mechanism presses the thermal head against the platen roller during printing. The positioning portion comes into contact with the thermal head from the printing direction when the pressing mechanism presses the thermal head against the platen roller. The positioning portion positions the thermal head with respect to the platen roller along the printing direction.

17 Claims, 8 Drawing Sheets

IMAGE FORMING DEVICE

CROSS-REFERENCE TO RELATED APPLICATIONS

This application claims priority to Japanese Patent Application No. 2006-169505 filed on Jun. 20, 2006. The entire disclosure of Japanese Patent Application No. 2006-169505 is hereby incorporated herein by reference.

BACKGROUND OF THE INVENTION

1. Field of the Invention

The present invention generally relates to an image forming device. More specifically, the present invention relates to an image forming device having a thermal head.

2. Background Information

A conventional sublimation type image forming device includes a thermal head having a printing head. With the conventional image forming device, an ink ribbon is superposed with recording paper composed of printer paper. The ink ribbon is coated with a sublimation dye. Electrical energy corresponding to image information is applied to the thermal head. The thermal energy generated by the thermal head causes the sublimation dye to sublimate and be transferred to the recording paper, such as special printer paper, thereby performing specific printing, such as color printing. With the conventional image forming device, rendering of an image with gradation is accomplished by controlling amounts of current sent to the thermal head, that is, amounts of heat generated by the printing head.

Another conventional image forming device includes a frame, a bushing, a platen roller and a thermal head (see Japanese Laid-Open Utility Model Application No. 2001-8, for example). The thermal head has a heat sink (heat radiating plate). The bushing is fitted to a protrusion provided to the heat sink. The bushing is latched to a latching portion of the frame. The thermal head contacts or separates from the platen roller.

Another conventional image forming device includes a frame, a thermal head substrate and a heat radiating plate. The heat radiating plate is joined to the thermal head substrate. A bearing provided to the heat radiating plate is engaged with a support shaft provided to the frame (see Japanese Laid-Open Patent Application No. H11-321013, for example).

With the conventional image forming devices, however, in printing, the printing head of the thermal head has to be positioned in a specific location with respect to the platen roller. Accordingly, the conventional image forming devices include a hinge portion, such as a latching portion or an engagement portion, for supporting the thermal head. The hinge portion is provided along a printing direction of the printing head so as to prevent position changes of the printing head due to frictional force during printing. Therefore, restrictions on the layout of parts, such as not being able to insert an ink ribbon cartridge from a side face of the frame, are imposed. These restrictions cause less latitude in design.

On the other hand, another conventional image forming device includes a side plate, a thermal head, a heat radiating plate, a curved head movement member and a platen roller (see Japanese Laid-Open Patent Application No. H11-254715, for example). The heat radiating plate is attached to the side plate via the curved head movement member so that an ink ribbon cartridge is inserted through a hole formed on the side plate. With the conventional image forming device, a hinge portion of the thermal head is provided along a printing direction of a printing head of the thermal head.

However, the conventional image forming device requires the curved head movement members and a fixing member, such as a screw, to attach the heat radiating plate to the curved head movement member. Also, since the thermal head is supported by combining the head movement member and the heat radiating plate, it is difficult to position the printing head of the thermal head with respect to the platen roller, which makes it difficult to render high-quality images. To solve the problem, the conventional image forming device further includes a reference positioning mechanism. The reference positioning mechanism has a reference positioning groove and an eccentric member for positional adjustment. The reference positioning groove is provided to the heat radiating plate and a thermal head attachment base of the thermal head. As a result, the conventional image forming device increases the number of parts required. Furthermore, the conventional image forming device also increases the number of assembly steps. Therefore, the cost of the conventional image forming device increases.

In view of the above, it will be apparent to those skilled in the art from this disclosure that there exists a need for an improved image forming device. This invention addresses this need in the art as well as other needs, which will become apparent to those skilled in the art from this disclosure.

SUMMARY OF THE INVENTION

The present invention is conceived to solve the above problems. One object of the present invention is to provide an image forming device having a simple configuration and with which supporting a thermal head and positioning a printing head along a printing direction are securely accomplished.

In accordance with one aspect of the present invention, an image forming device includes a thermal head, a head support portion, a platen roller, a pressing mechanism and a positioning portion. The thermal head prints in a printing direction. The head support portion rotatably supports the thermal head. The head support portion is supported at locations away from an imaginary line along the printing direction passing between the thermal head and the platen roller. The platen roller is disposed across from the thermal head. The pressing mechanism presses the thermal head against the platen roller during printing. The positioning portion comes into contact with the thermal head from the printing direction when the pressing mechanism presses the thermal head against the platen roller. The positioning portion positions the thermal head with respect to the platen roller along the printing direction.

With the image forming device, it is possible to provide an image forming device having a simple configuration and with which supporting a thermal head and positioning a printing head in a printing direction are securely accomplished.

These and other objects, features, aspects and advantages of the present invention will become apparent to those skilled in the art from the following detailed description, which, taken in conjunction with the annexed drawings, discloses selected embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
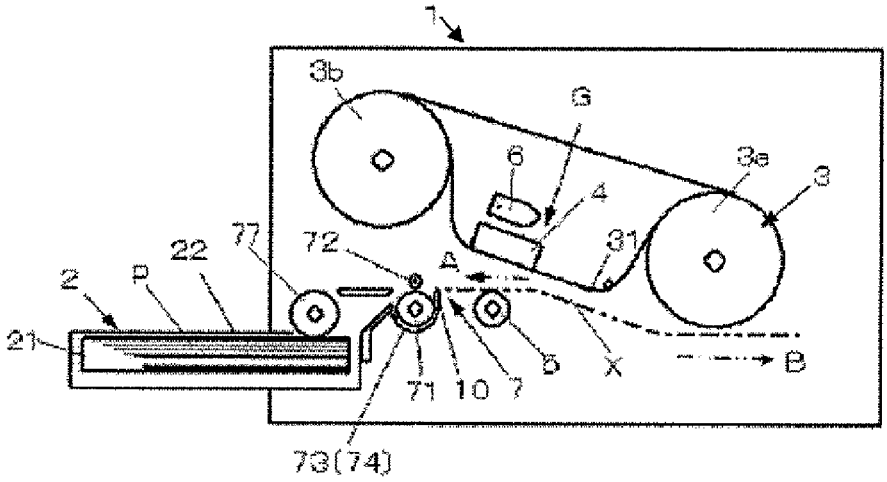
FIG. 1 is a schematic view of an image forming device pertaining to a first embodiment of the present invention.

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

A first embodiment of the present invention will now be described through reference to FIGS. 1 to 11.

As shown in FIGS. 1 to 4, an image forming device 1 includes a paper feed cartridge 2, an ink ribbon cartridge 3, an image forming unit G, a paper conveyance unit 7, a chassis 8, a drive unit 9 and a control unit (not shown). The paper feed cartridge 2 holds recording paper P, such as printer paper or the like. The ink ribbon cartridge 3 mounts an ink ribbon 31. The image forming unit G sublimates a sublimation dye that coats the ink ribbon 31, and forms an image on the recording paper P. The image forming unit G includes a thermal head 4, a platen roller 5, a torsion coil spring 55 and a pressing mechanism 6. The thermal head 4 performs printing in a printing direction A. The printing direction A is a direction in which the recording paper P is conveyed on the platen roller 5 when an image is formed on the recording paper P. The paper conveyance unit 7 successively conveys the recording paper P to the image forming unit G. The chassis 8 mounts the image forming unit G. The drive unit 9 has a drive motor, such as a stepping motor 91, and a gear group 92 including a drive gear, an intermediate gear, a cam gear 92*c* and so forth. The control unit of the image forming device 1 performs various control functions.

The recording paper P usually includes a printer paper base and a receiving layer formed on the printer paper base. The receiving layer is composed of a thermal transfer recording material. The thermal transfer recording material is generally produced by adding lubricants or the like to a polyester resin, polycarbonate resin or the like.

The paper feed cartridge 2 includes a holding member 21 and a lid 22. In the holding member 21, the recording paper P is placed and held. As a paper feed roller 77 of the paper conveyance unit 7 rotates, an uppermost sheet of a stack of the recording paper P placed in the holding member 21 is successively fed out to the paper conveyance unit 7.

The ink ribbon cartridge 3 includes a supply member 3*a* and a winding member 3*b*. The supply member 3*a* has a supply bobbin 32*a* rotatably provided to the supply member 3*a* and wound with the ink ribbon 31. The winding member 3*b* has a winding bobbin for winding the ink ribbon 31. The ink ribbon 31 includes a substrate made of paper or film, for example, that serves as a base. The substrate is coated with an ink produced by dissolving a sublimation dye in an acetate, polyester solution or the like, and adding a dispersant to create a colloidal solution. As is commonly known, a yellow printing region, magenta printing region, cyan printing region and surface protection layer region (OP layer) are provided to the ink ribbon 31. The yellow printing region, the magenta printing region, the cyan printing region and the surface protection layer region are substantially the same size as the maximum size (width and length) of the individual images being transferred. Identifiers are also provided between the regions.

Figure 2:
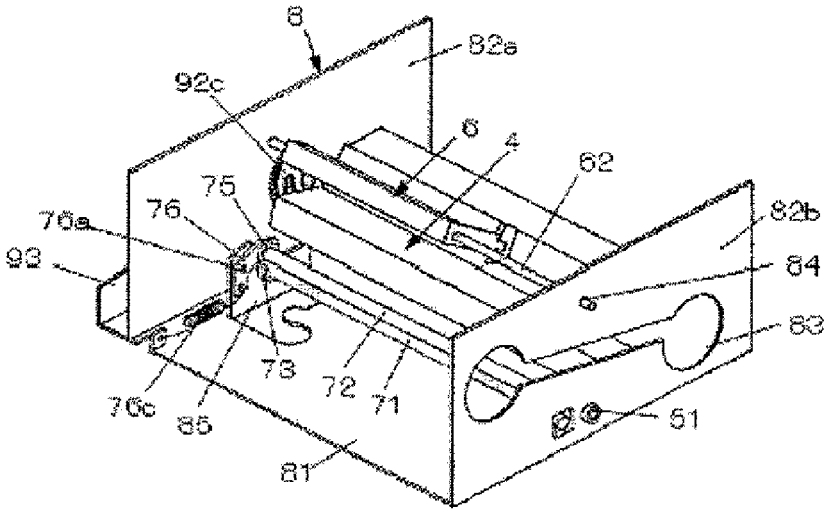
FIG. 2 is an oblique view of main components of the image forming device.

As shown in FIG. 2, the chassis 8 is formed by bending a steel plate or the like. The chassis 8 includes a bottom face 81 and first and second side faces 82*a* and 82*b* at both ends of the bottom face 81. A motor bracket 93 is mounted on the first side face 82*a*. A cartridge insertion hole 83 for inserting the ink ribbon cartridge 3 is provided at the second side face 82*b*. An insertion hole 84 for inserting a head presser spring 62 is provided at the first side face 82*a* and the second side face. The head presser spring 62 rotatably supports the pressing mechanism 6 and is provided between the first and second side faces 82*a* and 82*b*.

The thermal head 4 serves as a printing unit. The platen roller 5 is across from the thermal head 4 via the ink ribbon 31. The torsion coil spring 55 biases the thermal head 4 away from the platen roller 5. The pressing mechanism 6 presses the thermal head 4 against the platen roller 5 during printing.

Figure 4:
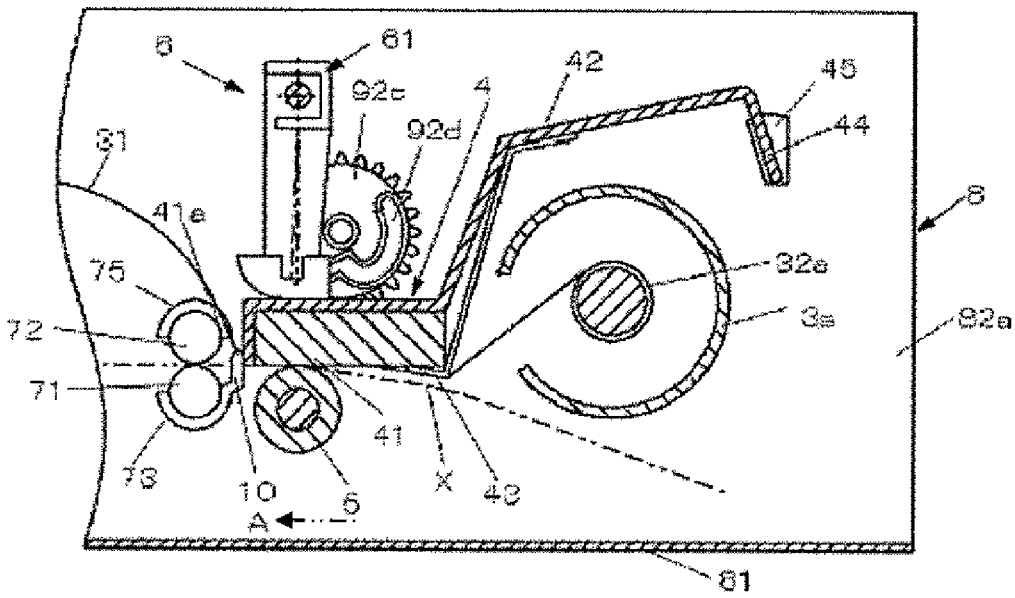
FIG. 4 is a partial sectional view of the main components illustrating a state in which a pressing mechanism of the image forming device is pressed against a thermal head.

As shown in FIG. 4, the thermal head 4 includes a printing head 41, a heat radiating plate 42, and a head cover 43. The heat radiating plate 42 radiates heat away from the printing head 41, and the head cover 43. The printing head 41 has heat generating elements that are arranged in a line over substantially the same length in the width direction (main scanning direction) as that of the image being printed. The heat generating elements convert electrical energy into thermal energy based on print data. Each of the heat generating elements is supplied with a color signal representing an image that is broken down into three primary colors of yellow (Y), magenta (M) and cyan (C). According to the color signal, the heat generating elements change between a state of generating heat and a state of non-generating heat.

The sublimation dye on the ink ribbon 31 across from the heat generating elements that are generating heat is sublimated or dissolved and diffused, and transferred to the recording paper P. As a result, an image is formed by recording one line at a time while the recording paper P is moved relatively in the printing direction A in FIG. 1.

The platen roller 5 is rotatably supported by platen roller bearings 51 provided to the first and second side faces 82*a* and 82*b* of the chassis 8 so as to be across from the thermal head 4.

Figure 3:
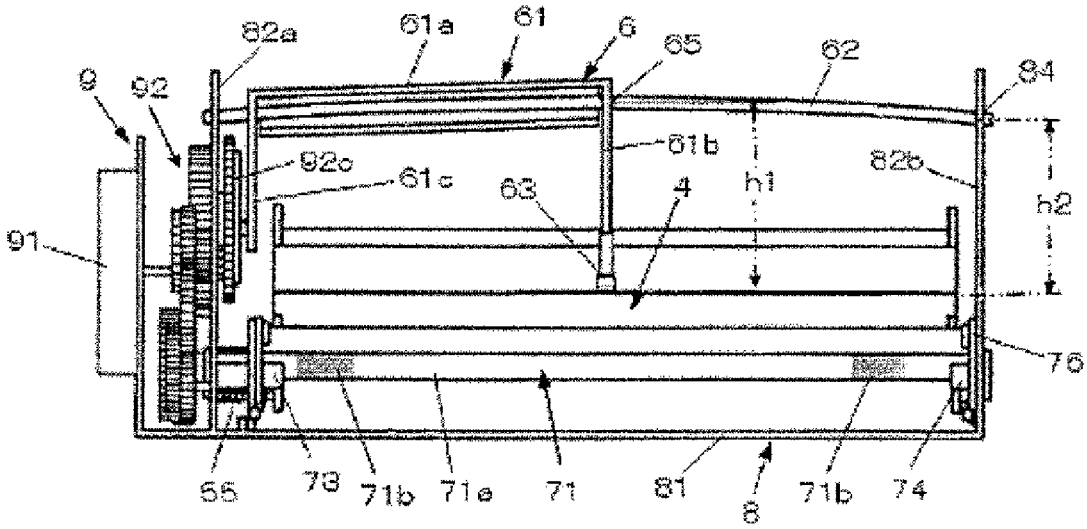
FIG. 3 is a front view of the main components of the image forming device.

As shown in FIGS. 2 to 4 and FIG. 10, the pressing mechanism 6 has a channel-shaped head presser bar 61, the bendable rod-shaped head presser spring 62 and a cap 63. The head presser spring 62 includes piano wire having a diameter of approximately 3 mm. The cap 63 is made of plastic, for example. The cap 63 comes into contact with a top of the head cover 43 of the thermal head 4. The head presser bar 61 has a linking portion 61*a*, a pressing portion 61*b* and a drive force transmission portion 61*c*. The linking portion 61*a* has a channel-shaped cross section. The pressing portion 61*b* is provided to one side face (or one end) of the linking portion 61*a*. The cap 63 is attached to a distal end of the pressing portion 61*b*. The drive force transmission portion 61*c* is provided to the other side face (or the other end) of the linking portion 61*a*. The drive force transmission portion 61*c* has a cam pin 64 that engages with a cam groove 92*d* (see FIG. 4) of the cam gear 92*c* of the gear group 92 of the drive unit 9. A hole 65 for attaching the head presser spring 62 is provided to the pressing portion 61*b* and the transmission portion 61*c* of the head presser bar 61. As shown in FIG. 3, a height h1 from a bottom face of the cap 63 to a center of the hole 65 in the pressing portion 61*b* of the head presser bar 61 is slightly (about to 2 to 3 mm, for instance) greater than a height h2 from a top of the heat radiating plate 42 over the printing head 41 during pressing to the center of the insertion hole 84 provided to the first and second side faces 82*a* and 82*b* of the chassis 8. Therefore, the head presser spring 62 is bent upward slightly (about to 2 to 3 mm, for instance) when the head presser spring 62 presses on the thermal head 4. When the head presser spring 62 presses the thermal head 4 to the platen roller 5, the bending of the head presser spring 62 securely presses the thermal head 4 to the platen roller 5.

The paper conveyance unit 7 includes a feed roller 71, a press roller 72 and a paper feed roller 77. A conveyance roller (not shown) is further provided if needed. The feed roller 71 is made of metal, for example, and provided downstream in the printing direction A. The press roller 72 is made of metal, for example, and provided across from the feed roller 71.

Figure 7:
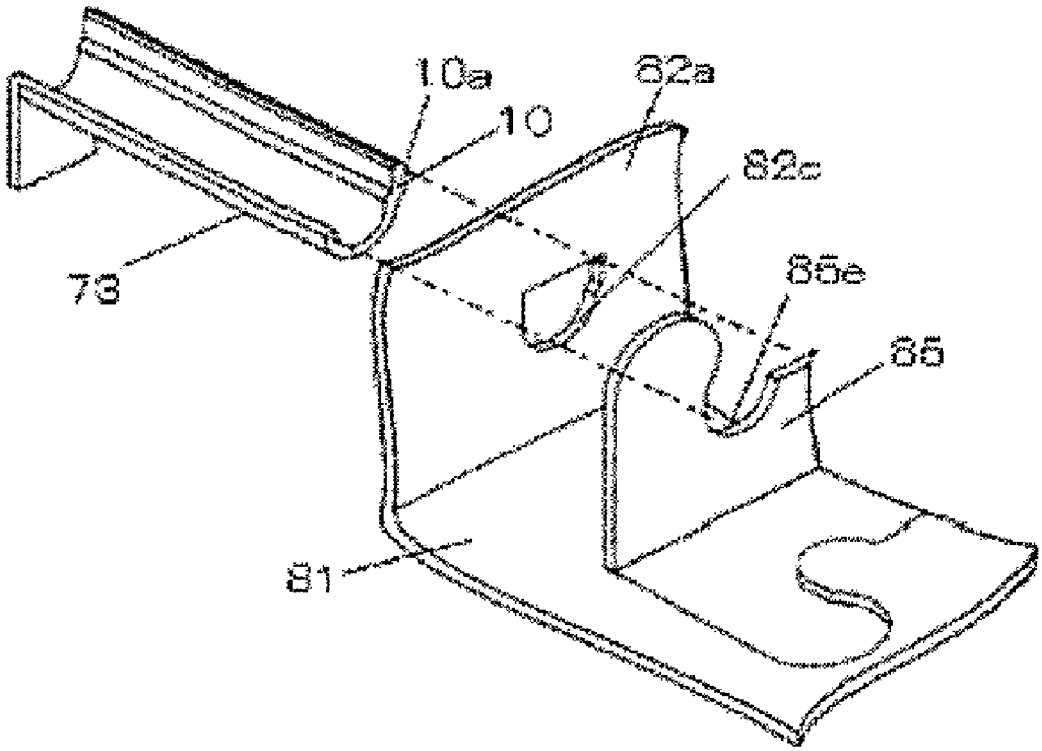
FIG. 7 is a partial oblique view illustrating a relationship between a first feed roller bearing and a first side face of the image forming device.
Figure 8:
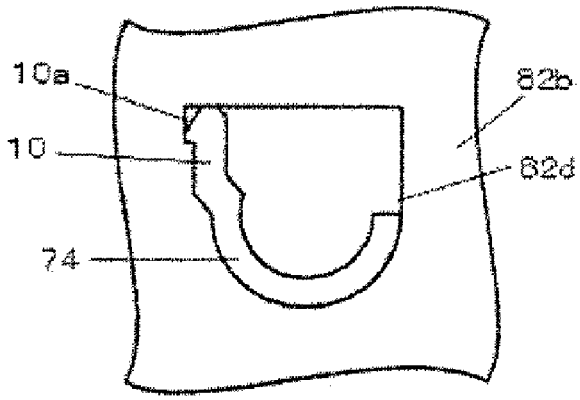
FIG. 8 is a partial front view illustrating a second feed roller bearing of the image forming device.
Figure 9:
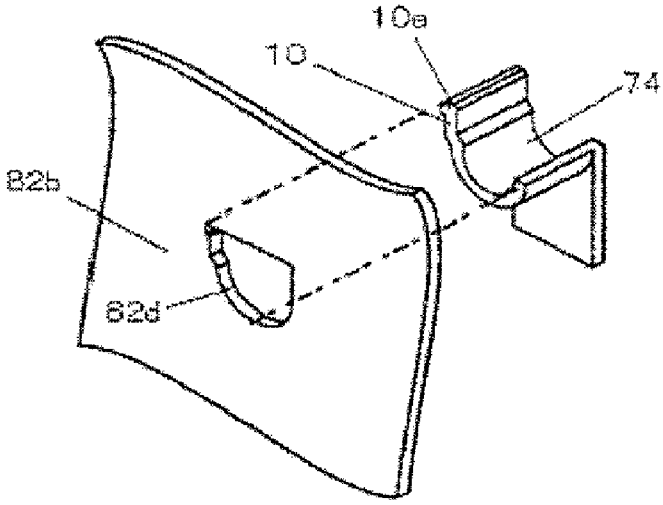
FIG. 9 is a partial oblique view illustrating a relationship between the second feed roller bearing and a second side face of the image forming device.
Figure 10:
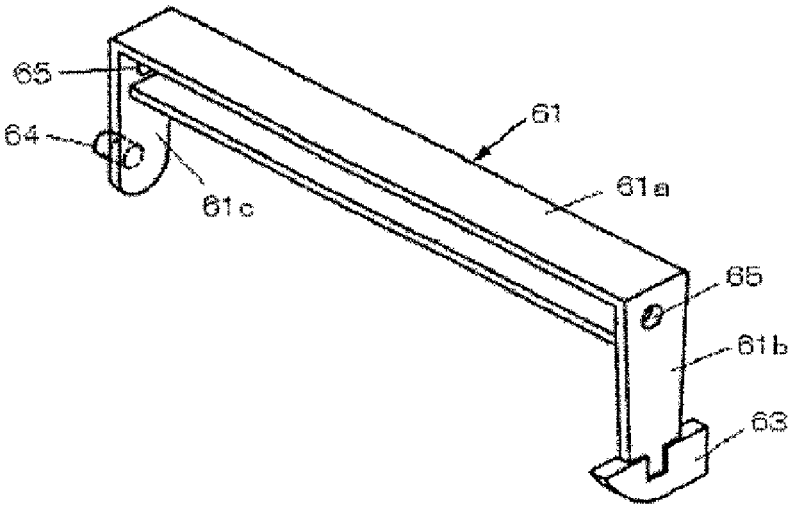
FIG. 10 is an oblique view illustrating a head presser bar of the image forming device.

As shown in FIGS. 1 to 4, the feed roller 71 is rotatably supported by first and second feed roller bearings 73 and 74. As shown in FIGS. 7 and 9, the first feed roller bearing 73 is longer in an axial direction than the second feed roller bearing 74. Referring to FIG. 7, the first feed roller bearing 73 is supported in a bearing support hole 82*c* provided to the first side face 82*a*, and a roller bearing support hole 85*e* provided to a bent tab 85 of the chassis 8. The bent tab 85 is formed by cutting and bending upward a part of the bottom face 81. The second feed roller bearing 74 is supported in a bearing support hole 82*d* provided to the second side face 82*b*, as shown in FIGS. 8 and 9, for example.

As shown in FIG. 3, the feed roller 71 includes a paper conveyance portion 71*a* and a plurality of protrusions 71*b*. The protrusions 71*b* have a specific height and are formed as needed by rolling (knurling) on part of a surface of the paper conveyance portion 71*a*. Forming the protrusions 71*b* is preferable in order to accurately convey the recording paper P via the paper conveyance portion 71*a*.

As shown in FIG. 2, the press roller 72 is rotatably supported by press roller bearings 75. The press roller bearings 75 are attached to bearing support portions 76 provided on inside of the second side face 82*a* and the bent tab 85, respectively. The bearing support portions 76 are attached rotatably around support points 76*a*. One of the bearing support portions 76 is attached on the inside of the second side face 82*b* and the other of the bearing support portions 76 is attached on the bent tab 85. The bearing support portions 76 are formed so that the press roller 72 is biased by a tension coil spring 76*c* in a direction of pressing against the feed roller 71.

The paper conveyance unit 7 is repeatedly moved back and forth in the lengthwise direction of the recording paper P (that is, in the printing direction A and the reverse direction B (or paper feed direction) over a paper path X) by the feed roller 71, and the press roller 72 provided across from the feed roller 71 according to the regions of each of the colors successively transferred. As a result, superposed color printing is carried out by the ink ribbon 31 coated with three colors of sublimation dye. Also, the control unit (not shown) drives the drive unit 9 and controls the system so that during printing, as shown in FIG. 4, the thermal head 4 is pressed to the platen roller 5 against the spring force of the torsion coil spring 55. The control unit also controls the system so that during paper feed and discharge, the pressing force of the pressing mechanism 6 is released, and the thermal head 4 retracts (see FIG. 11).

The recording paper P conveyed to the image forming unit G is conveyed from the right to the left in FIG. 1 (that is, in the printing direction A) at substantially the same speed as the ink ribbon 31. In parallel with this, yellow image data is supplied from the control unit (not shown) to the printing head 41. This results in heat being generated from the heat generating elements of the printing head 41. Then, the sublimation dye in the portion across from the generating elements is transferred (adheres) to the surface of the recording paper P, and a yellow (Y) image is formed on the recording paper P. Once the formation of the yellow image on the surface of the recording paper P is complete, the rotation of the cam gear 92*c* causes the cam pin 64 to rotate and the pressing force of the pressing mechanism 6 to be released. As a result, the printing head 41 is lifted by the spring force of the torsion coil spring 55.

After that, the control unit winds up the ink ribbon 31 until a distal end of the magenta printing region of the ink ribbon 31 is detected by an ink ribbon sensor or the like (not shown). The paper conveyance unit 7 is driven to convey the recording paper P in the reverse direction B (reverse from the printing direction A) until the distal end reaches a proper printing location. This operation makes it possible to form a magenta image on the recording paper P. After that, the above operation is repeated for magenta, cyan and a surface protective layer (colorless and transparent) so as to form a color image, that is, perform superposed color printing, in an image region on the surface of the recording paper P. The printing head 41 is raised upward at first (before printing) to form enough of a gap between the printing head 41 and the platen roller 5 so as not to impede the conveyance of the ink ribbon 31 and the recording paper P.

Once the formation of the color image on the recording paper P is complete, the control unit drives the stepping motor 91 of the drive unit 9 in reverse so that the pressing force of the pressing mechanism 6 on the printing head 41 is released and the printing head 41 is raised. Furthermore, the control unit controls the paper conveyance unit 7 so that the recording paper P is discharged from the main part of the apparatus. The recording paper P is conveyed to a discharge portion (not shown) provided near the top of the lid 22 of the paper feed cartridge 2.

Figure 5:
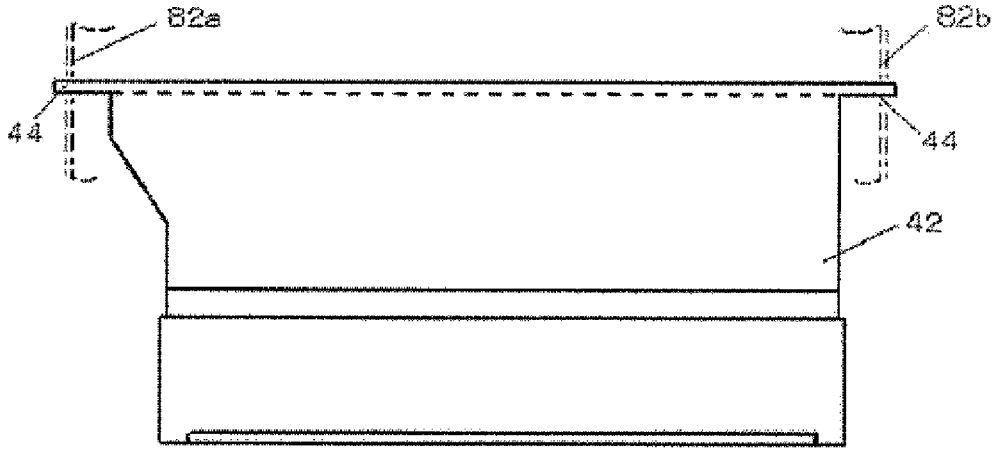
FIG. 5 is a plan view illustrating a heat radiating plate of the image forming device.
Figure 6:
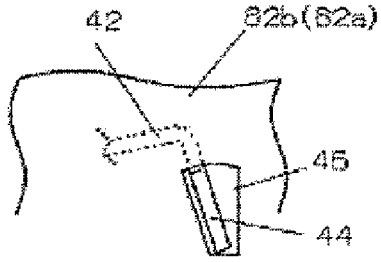
FIG. 6 is a partial side view illustrating a relationship between a head support shaft and a head support bearing of the image forming device.

As shown in FIGS. 4 to 6, the heat radiating plate 42 includes a head support shaft or head support portion 44. Specifically, as shown in FIGS. 5 and 6, the head support shaft 44 is integrally formed with part of the heat radiating plate 42 integrally mounted to the printing head 41. Furthermore, the head support shaft 44 is formed by bending one end of the heat radiating plate 42 so that the head support shaft 44 has a square cross sectional shape. Thus, the head support shaft 44 is easier to machine. The head support shaft 44 supports the thermal head 4 and serves as a rotational center of the thermal head 4. The head support shaft 44 is provided such that the head support shaft 44 loosely passes through head support bearings 45. The head support bearings 45 includes fan-shaped through-holes provided on the first and second side faces 82*a* and 82*b* of the chassis 8. Furthermore, the head support bearings 45 are disposed away from an imaginary line along the printing direction A passing between the thermal head 4 and the platen roller 5 (away from the paper path X of the recording paper P). Specifically, the imaginary line passes through a contact point of the thermal head 4 and the platen roller 5 during printing. As a result, the head support shaft 44 is rotatably supported by the head support bearings 45 so as to be capable of a specific amount of movement (a specific amount of play) along the printing direction A.

As shown in FIGS. 7 to 9, the first and second feed roller bearings 73 and 74 include a positioning portion 10. More specifically, the positioning portion 10 is integrally formed on the printing head 41 side of the first and second feed roller bearings 73 and 74. Thus, an increase in separate parts is prevented. As shown in FIGS. 1 and 4, the positioning portion 10 is disposed in the printing direction A of the thermal head 4 (downstream of the thermal head 4). Furthermore, the positioning portion 10 comes into contact with the distal end portion 41*a* of the thermal head 4 from the printing direction A (in the reverse direction B) when the printing head 41 is pressed against the platen roller 5 by the pressing mechanism 6, and positions the printing head 41 with respect to the platen roller 5 along the printing direction A. Therefore, the first and second feed roller bearings 73 and 74 function as positioning members for the thermal head 4. The positioning portion 10 includes a tapered portion (chamfered portion) 10*a* formed on an upper end of the positioning portion 10. The tapered portion 10*a* is formed by chamfering or the like. Forming the tapered portion 10*a* is preferable because when the printing head 41 is pressed against the platen roller 5 by the pressing mechanism 6, the distal end portion 41*a* of the thermal head 4 moves more smoothly along the tapered portion 10*a*.

Figure 11:
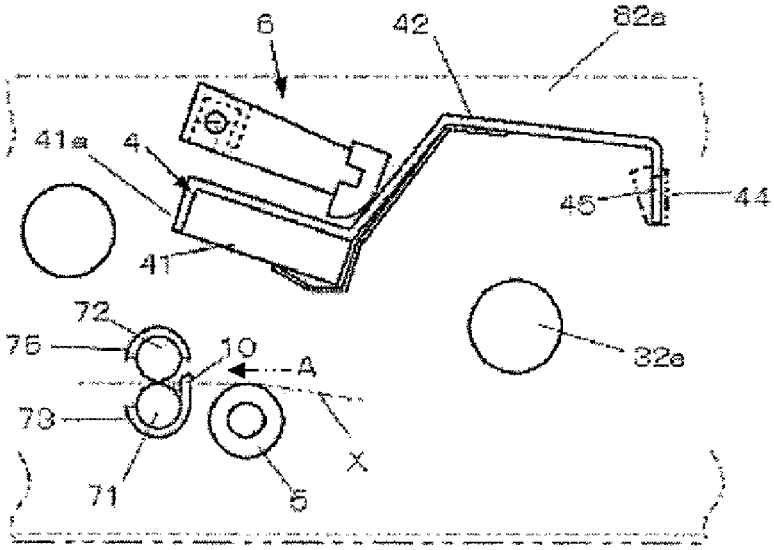
FIG. 11 is a schematic diagram illustrating a state in which the thermal head is in a retracted position of the image forming device.
Figure 12:
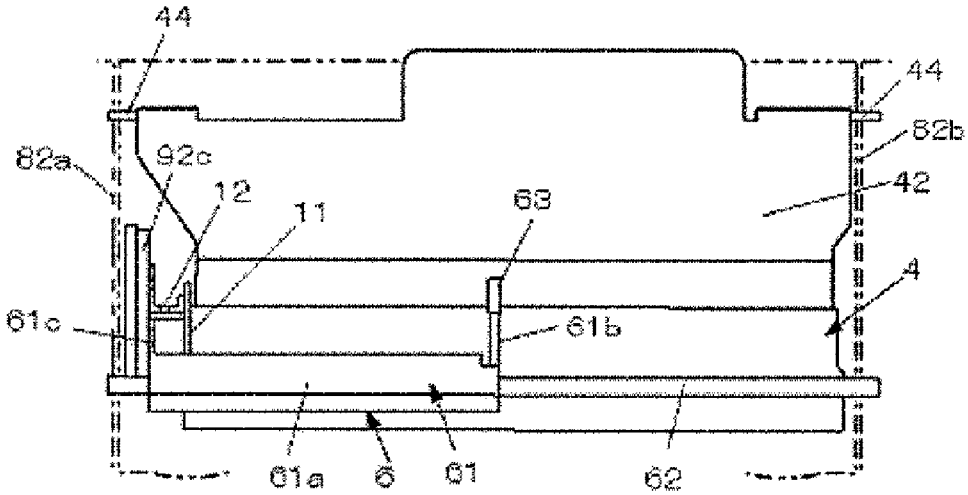
FIG. 12 is a plan view of main components of an image forming device pertaining to a second embodiment of the present invention.
Figure 13:
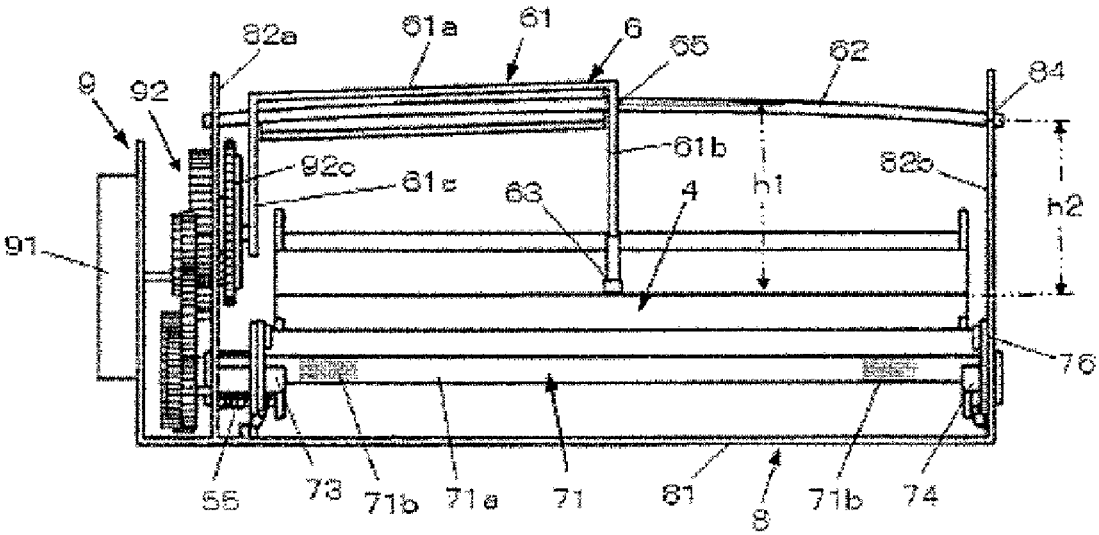
FIG. 13 is a front view of the main components of the image forming device.
Figure 14:
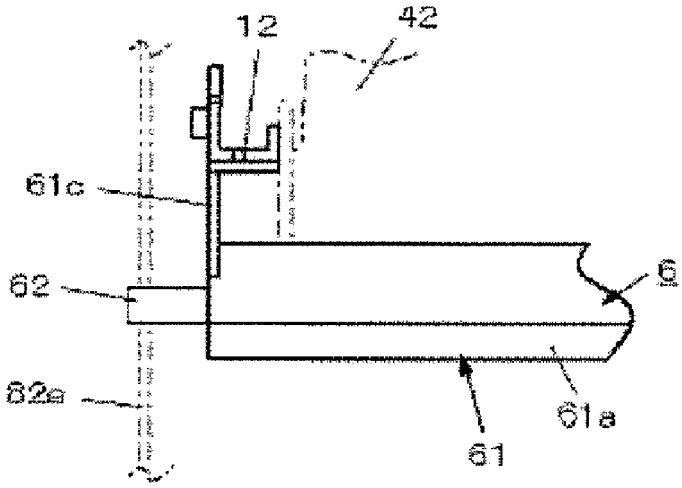
FIG. 14 is a enlarged plan view of a pressing mechanism of the image forming device.
Figure 15:
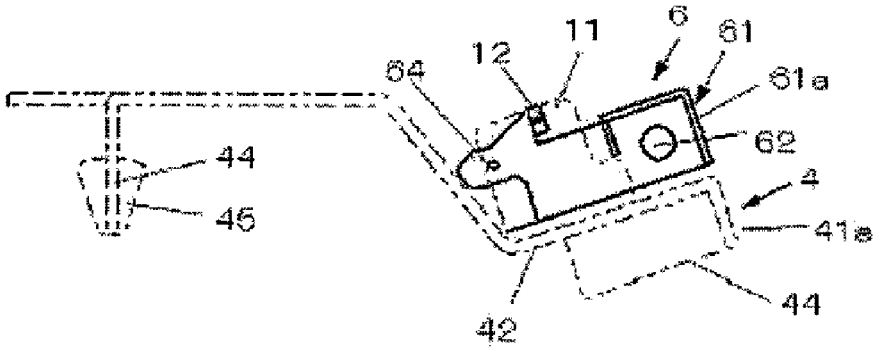
FIG. 15 is a side view of the pressing mechanism of the image forming device.

During the printing, the thermal head 4 leaves a retracted state as shown in FIG. 11. Specifically, the operation of the drive unit 9 causes the thermal head 4 to be pressed by the pressing mechanism 6 to the platen roller 5 against the spring force of the torsion coil spring 55. Then, the distal end portion 41*a* of the thermal head 4 is pressed tightly against the platen roller 5 along the tapered portion 10*a* at the upper end of the positioning portion 10. As a result, the distal end portion 41*a* of the thermal head 4 comes into contact with the positioning portion 10. Since the head support shaft 44 passes loosely through the head support bearings 45, that is, passes through with a gap (or a play) provided, the thermal head 4 moves along the printing direction A. Then, the distal end portion 41*a* of the thermal head 4 comes into contact with the positioning portion 10. As a result, the printing head 41 of the thermal head 4 is positioned in a specific location with respect to the platen roller 5, and printing is performed. As shown in FIG. 4, in the printing state, the pressing mechanism 6 presses on the top of the thermal head 4 at the desired pressing force.

Since the head support shaft 44 is supported by the head support bearings 45 that are disposed at locations away from the imaginary line along the printing direction A or the reverse direction B (or away from the paper path X of the recording paper P), the head support shaft 44 does not restrict the layout of the various parts. Therefore, there is greater latitude in design. Furthermore, the head support shaft 44 is integrally formed by part of the heat radiating plate 42 and supported so as to pass loosely through the head support bearings 45. The head support bearings 45 include through-holes formed at locations away from the imaginary line along the printing direction A on the first and second side faces 82*a* and 82*b*. As a result, when the thermal head 4 comes into contact with the platen roller 5 during printing, the thermal head 4 is moved along the printing direction A (or along the paper path X). Then, the distal end portion 41*a* of the thermal head 4 comes into contact with the positioning portion 10 provided to the feed roller bearings 73 and 74. Therefore, the printing head 41 is securely positioned in a specific location with respect to the platen roller 5 with a simple constitution. Furthermore, printed image quality is enhanced.

Since the positioning portion 10 is provided to the first and second feed roller bearings 73 and 74 provided at extremely nearby locations when the printing head 41 is pressed against the platen roller 5 by the pressing mechanism 6, the printing head 41 is positioned more accurately.

Since the head support shaft 44 is integrally formed by part of the heat radiating plate 42, there is not an increase in the number of parts as compared to if the head support shaft 44 is provided separately.

The head support shaft 44 passes loosely through the head support bearings 45 including fan-shaped through-holes. Therefore, the head support shaft 44 moves more smoothly within the desired range when the thermal head 4 comes into contact with and moves away from the platen roller 5, such as during the feed and discharge of the recording paper P, during paper cueing, upon completion of printing and during printing.

Second Embodiment

Referring now to FIGS. 12-15, a second embodiment of the present invention will now be described. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

As shown in FIGS. 12 to 15, a striker plate 11 is provided on the drive force transmission portion 61*c* side of the pressing mechanism 6. Specifically, the striker plate 11 is formed by bending a side portion of the heat radiating plate 42. It is favorable for the striker plate 11 to be formed by bending the side portion of the heat radiating plate 42 because the number of separate parts are not increased. Also, a retainer 12 is provided to the drive force transmission portion 61*c* of the head presser bar 61 of the pressing mechanism 6. The retainer 12 strikes the striker plate 11. The retainer 12 is formed by bending part of the drive force transmission portion 61*c* in an L-shape to the striker plate 11 side. It is favorable for the retainer 12 to be formed by bending part of the drive force transmission portion 61*c* in an L-shape because the number of separate parts are not increased.

In the assembly of the thermal head 4 and the pressing mechanism 6, the thermal head 4 is first mounted on the chassis 8. Specifically, the head support shaft 44 of the thermal head 4 is supported in a state of loosely passing through the head support bearings 45 provided to the first and second side faces 82*a* and 82*b*. Then, the pressing mechanism 6 is mounted on the chassis 8. Specifically, after the head presser spring 62 is mounted on the head presser bar 61, the head presser bar 61 is mounted on the chassis 8 so that the retainer 12 comes into contact with the striker plate 11. As a result, the head support shaft 44 is prevented from coming loose from the first and second side faces 82*a* and 82*b*.

The image forming device of the second embodiment has the same effects as those of the first embodiment discussed above. Furthermore, since the retainer 12 strikes the striker plate 11, the head support shaft 44 is prevented from coming loose from the first and second side faces 82*a* and 82*b*. Furthermore, the constitution of the image forming device is simple.

The embodiments discussed above are preferred working examples of the present invention, but the present invention is not limited to or by these, and various modifications are possible without exceeding the gist of the present invention.

For example, in the embodiments discussed above, the positioning portion 10 is provided at the first and second feed roller bearings 73 and 74. However, a protrusion that comes into contact with the first and second feed roller bearings 73 and 74 may be provided to the distal end portion 41*a* of the thermal head 4, and the protrusion may function as the positioning portion 10.

The positioning portion 10 may be provided separately inside the first and second side faces 82*a* and 82*b* of the chassis 8. In this case, the distal end portion 41*a* of the thermal head 4 or a side portion of the thermal head 4 comes into contact with the positioning portion 10, and the printing head 41 of the thermal head 4 is positioned at the desired location.

Furthermore, the present invention may be applied, for example, to a thermal head-type image forming device in which an ink ribbon is not used. Specifically, heat-sensitive recording paper equipped with a heat-sensitive coloration layer is used as the recording paper P. The heat-sensitive recording paper is heated with a thermal head to record a color image. Furthermore, the thermal head may be a sublimation-type, a laser sublimation-type, a thermal transfer-type and so forth.

General Interpretation of Terms

In understanding the scope of the present invention, the term "comprising" and its derivatives, as used herein, are intended to be open ended terms that specify the presence of the stated features, elements, components and/or groups, but do not exclude the presence of other unstated features, elements, components and/or groups. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an image forming device equipped with the present invention. Accordingly, these terms, as utilized to describe the present invention should be interpreted relative to an image forming device equipped with the present invention as used in the normal operating position. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming device comprising:

a thermal head configured to print in a printing direction;

a platen roller disposed across from the thermal head;

a head support portion rotatably supporting the thermal head, the head support portion being supported at locations away from an imaginary line along the printing direction passing between the thermal head and the platen roller;

a pressing mechanism configured to press the thermal head against the platen roller during printing; and a positioning portion configured to contact the thermal head from the printing direction when the pressing mechanism presses the thermal head against the platen roller and position the thermal head with respect to the platen roller along the printing direction.

2. The image forming device according to claim 1, wherein the head support portion is supported by head support bearings disposed at locations away from the imaginary line.

3. The image forming device according to claim 2, wherein the positioning portion is disposed in the printing direction of the thermal head.

4. The image forming device according to claim 2 further comprising a chassis having a bottom face and side faces disposed at ends of the bottom face, the thermal head including a heat radiating plate configured to radiate heat away from the thermal head, and the head support portion being integrally formed with the heat radiating plate, and being configured to be supported by the head support bearings formed in the side faces of the chassis so as to pass loosely through the head support bearings.

5. The image forming device according to claim 4, wherein the head support bearings include fan-shaped through-holes, and the head support portion is configured to pass loosely through the through-holes.

6. The image forming device according to claim 4, wherein the head support portion is formed by bending a part of the heat radiating plate, and the head support portion has a square cross sectional shape.

7. The image forming device according to claim 4, wherein the heat radiating plate includes a striker plate provided to the heat radiating plate, and the pressing mechanism includes a channel-shaped head presser bar having a linking portion, a pressing portion provided to one end of the linking portion, the pressing portion being configured to press the thermal head against the platen roller, and a drive force transmission portion provided to the other end of the linking portion, the drive force transmission portion having a retainer and a cam pin for transmitting drive, the retainer being configured to strike the striker plate of the heat radiating plate to prevent the head support portion from coming loose from the side faces of the chassis.

8. The image forming device according to claim 7, wherein the pressing mechanism includes a bendable rod-shaped head presser spring configured to pass through the pressing portion and the drive force transmission portion, the head presser spring being disposed between the side faces of the chassis, the head presser spring being further configured to press the thermal head by bending when the thermal head presses the platen roller.

9. The image forming device according to claim 2, wherein the head support bearings include fan-shaped through-holes, and the head support portion is configured to pass loosely through the through-holes.

10. The image forming device according to claim 1 further comprising a feed roller configured to convey recording paper between the thermal head and the platen roller; and feed roller bearings configured to rotatably support the feed roller, the positioning portion being provided to the feed roller bearings.

11. The image forming device according to claim 10, wherein the positioning portion is formed integrally with the feed roller bearings.

12. An image forming device comprising:

a chassis including a bottom face and side faces disposed at ends of the bottom face;

a thermal head configured to print in a printing direction, the thermal head including a printing head and a heat radiating plate configured to radiate heat away from the printing head, the heat radiating plate being attached to the thermal head;

a platen roller disposed across from the thermal head and rotatably supported between the side faces of the chassis;

a head support portion rotatably supporting the thermal head, the head support portion being supported by head support bearings disposed at locations away from an imaginary line along the printing direction passing between the thermal head and the platen roller, the head support portion being configured to pass loosely through the head support bearings;

a pressing mechanism configured to press the thermal head against the platen roller during printing;

a feed roller configured to convey recording paper between the thermal head and the platen roller;

feed roller bearings disposed on the side faces of the chassis and configured to rotatably support the feed roller; and a positioning portion configured to contact the thermal head from the printing direction when the pressing mechanism presses the thermal head against the platen roller and position the thermal head with respect to the platen roller along the printing direction, the positioning portion being provided to the feed roller bearings.

13. The image forming device according to claim 12, wherein the head support bearings include fan-shaped through-holes, and the head support portion is configured to pass loosely through the through-holes.

14. The image forming device according to claim 12, wherein the head support portion is formed by bending a part of the heat radiating plate, and the head support portion has a square cross sectional shape.

15. The image forming device according to claim 12, wherein the positioning portion is formed integrally with the feed roller bearings.

16. The image forming device according to claim 12, wherein the heat radiating plate includes a striker plate provided to the heat radiating plate, and the pressing mechanism includes a channel-shaped head presser bar having a linking portion, a pressing portion provided to one end of the linking portion, the pressing portion being configured to press the thermal head against the platen roller, and a drive force transmission portion provided to the other end of the linking portion, the drive force transmission portion having a retainer and a cam pin for transmitting drive force, the retainer being configured to strike the striker plate of the heat radiating plate so as to prevent the head support portion from coming loose from the side faces of the chassis.

17. The image forming device according to claim 16, wherein the pressing mechanism includes a bendable rod-shaped head presser spring configured to pass through the pressing portion and the drive force transmission portion, the head presser spring being disposed between the side faces of the chassis, the head presser spring being further configured to press the thermal head by bending when the thermal head presses the platen roller.

* * * * *